US006386762B1

(12) United States Patent
Randall et al.

(10) Patent No.: US 6,386,762 B1
(45) Date of Patent: May 14, 2002

(54) FLEXIBLE STORAGE BAG WITH STRUCTURAL ALTERATION OF BAG OPENING TO PROVIDE CLOSURE INDICATION

(75) Inventors: Catherine Jean Randall; Matthew Todd Hupp, both of Cincinnati; Beverly Julian Jackson, Hamilton, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/642,173

(22) Filed: Aug. 18, 2000

Related U.S. Application Data

(60) Provisional application No. 60/150,027, filed on Aug. 20, 1999.

(51) Int. Cl.[7] ..... B65D 33/16
(52) U.S. Cl. ..... 383/64; 383/35
(58) Field of Search ..... 383/5, 63, 64, 383/65, 202, 86, 97, 35

(56) References Cited

U.S. PATENT DOCUMENTS

| | | | | | |
|---|---|---|---|---|---|
| 4,241,865 | A | * | 12/1980 | Ferrell | 383/97 X |
| 4,337,889 | A | * | 7/1982 | Moertel | 383/97 X |
| 4,479,244 | A | * | 10/1984 | Ausnit | 383/63 |
| 4,736,496 | A | | 4/1988 | Fisher et al. | |
| 4,846,586 | A | * | 7/1989 | Bruno | 383/65 X |
| 4,905,298 | A | | 2/1990 | Walor | |
| 5,037,138 | A | * | 8/1991 | McClintock et al. | 383/43 X |
| 5,070,584 | A | | 12/1991 | Dais et al. | |
| 5,138,750 | A | | 8/1992 | Gundlach et al. | |
| 5,140,727 | A | | 8/1992 | Dais et al. | |
| 5,211,482 | A | | 5/1993 | Tilman | |
| 5,294,470 | A | | 3/1994 | Ewan | |
| 5,316,386 | A | * | 5/1994 | Moore | 383/63 X |
| 5,403,094 | A | | 4/1995 | Tomic | |
| 5,611,627 | A | | 3/1997 | Belias et al. | |
| 5,647,100 | A | | 7/1997 | Porchia et al. | |
| 5,669,715 | A | * | 9/1997 | Dobreski et al. | 383/64 X |
| 5,681,115 | A | * | 10/1997 | Diederich et al. | 383/64 |
| 5,722,128 | A | | 3/1998 | Toney et al. | |
| 5,774,955 | A | | 7/1998 | Borchardt et al. | |
| 6,022,144 | A | * | 2/2000 | Hausslein | |

FOREIGN PATENT DOCUMENTS

| | | | | |
|---|---|---|---|---|
| BE | 0558410 | * | 3/1960 | 383/86 |
| EP | 0345838 | | 12/1989 | |
| FR | 1.079.480 | * | 11/1954 | 383/63 |
| FR | 1.140.7523 | * | 8/1957 | 383/63 |
| FR | 2759981 | | 8/1998 | |

* cited by examiner

*Primary Examiner*—Jes F. Pascua
(74) *Attorney, Agent, or Firm*—David K. Mattheis; David M. Weirich; Larry L. Huston

(57) ABSTRACT

The present invention provides a flexible storage bag having an opening, a closure system for the opening, and a closure indicator. The closure indicator may be provided by, at or near the edges of the bag which define the opening. For example, the edges may be sinusoidal in shape or have another irregular shape, such that misalignment of the edges occurs when the bag is open. Upon closing the bag, the edges substantially align and become generally colinear. Alternatively, the closure indicator may comprise a mechanical seal which becomes colinear upon closing. In an alternative embodiment, flaps may be juxtaposed with the closure system. The flaps encounter a change of position upon closure of the bag. The change in position may either be complete severance from the bag, or inflect from a first position to a second position upon closure or opening of the bag. Closure and/or opening of the bag may be accomplished by a slider.

1 Claim, 2 Drawing Sheets

FLEXIBLE STORAGE BAG WITH STRUCTURAL ALTERATION OF BAG OPENING TO PROVIDE CLOSURE INDICATION

CROSS REFERENCE TO RELATED APPLICATION

This application claims the benefit of U.S. Provisional Application No. 60/150,027, filed on Aug. 20, 1999.

FIELD OF THE INVENTION

The present invention relates to closures such as those commonly employed on flexible storage bags, particularly those suitable for use in the containment and protection of various items including perishable materials.

BACKGROUND OF THE INVENTION

Flexible storage bags for use in the containment and protection of various items, as well as the preservation of perishable materials such as food items, are well known in the art. Such bags typically comprise a rectangular sheet of polymeric film folded upon itself and sealed along two edges to form a semi-enclosed container having two flexible opposed sidewalls, three sealed or folded edges, and one open edge. A closure integrally formed with the bag such as an interlocking rib-type seal or separately provided such as a plastic or paper-clad-wire tie completes the containment assembly.

As utilized herein, the term "flexible" is utilized to refer to materials which are capable of being flexed or bent, especially repeatedly, such that they are pliant and yieldable in response to externally applied forces. Accordingly, "flexible" is substantially opposite in meaning to the terms inflexible, rigid, or unyielding. Materials and structures which are flexible, therefore, may be altered in shape and structure to accommodate external forces and to conform to the shape of objects brought into contact with them without losing their integrity. Flexible storage bags of the foregoing variety are typically formed from polymeric film, such as polyethylene or other members of the polyolefin family, in thicknesses of between about 0.0002 inches to about 0.002 inches. Such films are frequently transparent but sometimes are opaque and/or colored.

Flexible storage bags of the currently commercially available variety provide a means of conveniently storing a wide range of objects and materials in a generally disposable containment device. Many commercially available flexible storage bags utilize mechanical interlocking seals to achieve closure of the bag opening, and some such bags additionally employ a sliding mechanical closure to improve the ease of opening and closing mechanical interlocking seals. With either type of mechanical interlocking seal, there remains the issue of determining whether complete closure has in fact been completed across the mouth of the bag to achieve the desired completion of the closing operation.

Accordingly, it would be desirable to provide a closure which provides for a positive indication of when a complete closure has been achieved.

SUMMARY OF THE INVENTION

The present invention provides a flexible storage bag having an opening, a closure system for the opening, and a closure indicator. The bag is semi-enclosed and has an opening defined by two edges. The closure indicator changes position in response to opening and/or closing of the bag.

In one embodiment, the closure indicator may comprise two misaligned edges defining the opening of the bag. The edges may be misaligned when the bag is open but substantially colinear when the bag is closed. In one execution, the bag may be generally planar and the misalignment of the edges lie within the plane of the bag. In another execution, the misalignment may be disposed generally perpendicular to the plane of the bag.

In another embodiment, the closure indicator may be a mechanical seal. The mechanical seal may be operated by a slider. The closure indicator may comprise one or more flaps juxtaposed with the mechanical seal. The flaps change position in response to translation of the slider. In one execution, the slider may sever the flap from the bag upon translation. In another execution, the flap may fold from a first position to a second position due to the translation of the slider.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
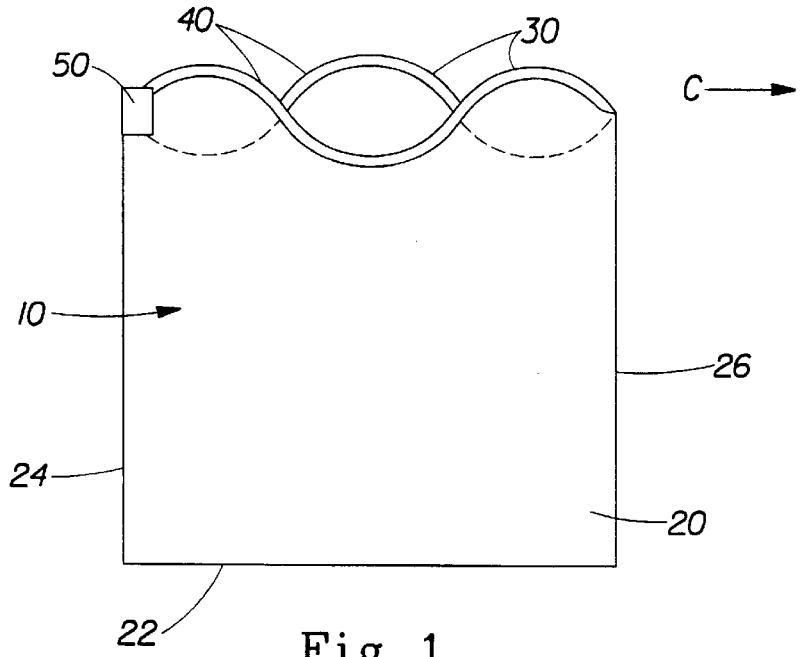
FIG. 1 is an elevational view of an open flexible bag employing a closure indicator in accordance with the present invention, the bag being planar and the closure indicator lying within the plane of the bag.

FIG. 1 depicts a presently preferred embodiment of a flexible storage bag 10 according to the present invention. FIG. 1 depicts a generally planar bag 10 having misalignment lying within the plane of the bag 10. In the embodiment depicted in FIG. 1, the flexible storage bag 10 includes a bag body 20 formed from a piece of flexible sheet material folded upon itself along fold line 22 and bonded to itself along side seams 24 and 26 to form a semi-enclosed container having an opening along edge 30. Flexible storage bag 10 also includes a mechanical closure system 40 located adjacent to edge 30 for sealing edge 30 to form a fully-enclosed container or vessel. Bags such as the flexible storage bag 10 of FIG. 1 can be also constructed from a continuous tube of sheet material, thereby eliminating side seams 24 and 26 and substituting a bottom seam for fold line 22. The mechanical closure system 40 includes an interlocking mechanical seal of any suitable conventional design, and may optionally include a sliding mechanical element (slider) 50 as shown in the embodiment of FIG. 1 for opening and closing the interlocking mechanical seal. The sliding mechanical closure 50 may be of suitable conventional design for the type of interlocking mechanical seal employed. Interlocking mechanical seals may include opposed ribs having complementary interlocking shapes, an opposing rib/channel pair with complementary interlocking shapes, or other configurations such as those known in the art.

FIG. 1 illustrates the flexible bag 10 with the closure 40 in the open or unsecured position. In this position, the opposed portions of the upper edge 30, defined by the closure 40, exhibit diverse profile shapes, preferably with substantially complete misalignment of the mating portions of the mechanical interlocking seal of the closure 40. Accordingly, it is readily apparent to a consumer viewing the bag 10 from either side that the bag 10 is indeed unsecured, thereby providing a corresponding visual indication. The opposed portions of the upper edge 30 and closure 40 may have sinusoidal or any desired shape so long as the shapes are sufficiently diverse so as to provide the desired visual indication.

Figure 2:
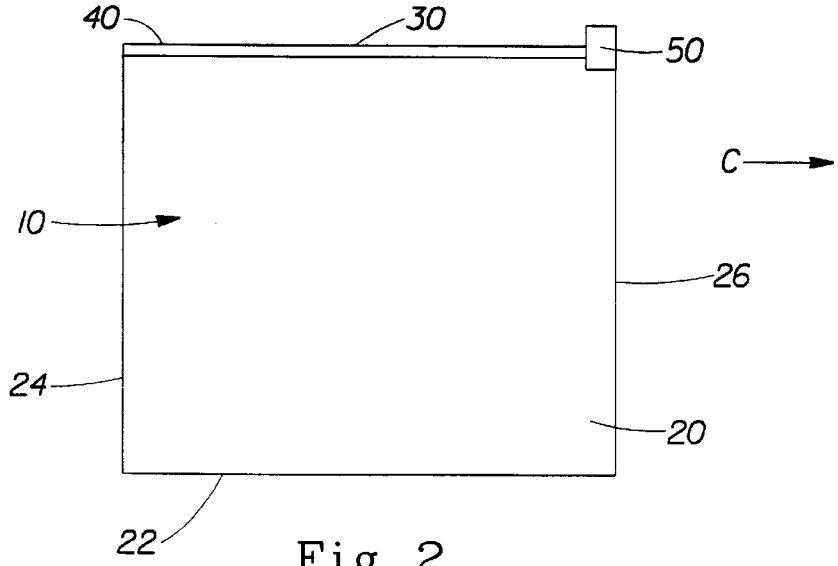
FIG. 2 is an elevational view of the bag of FIG. 1 in a fully closed condition.

FIG. 2 shows the flexible bag 10 with the closure 40 fully secured via moving the optional slider 50 in the direction "C", thereby drawing the opposed portions of the upper edge 30 with closure 40 into alignment. The change in the configuration of the upper edge 30 of the bag 10 forming the opening provides a clear visual indication of the status of the closure 40, with the now-corresponding shapes providing indication that successful closure has been achieved.

Figure 3:
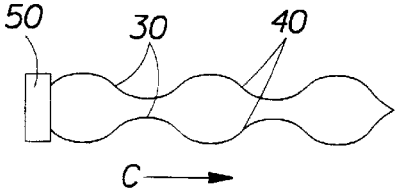
FIG. 3 is a top plan view of another open flexible bag employing a closure indicator in accordance with the present invention, the bag being generally planar, the closure indicator lying perpendicular to the plane of the bag.
Figure 4:
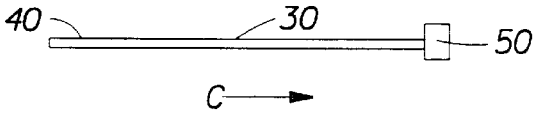
FIG. 4 is a top plan view of the bag of FIG. 3 in a fully closed condition.

FIGS. 3 and 4 depict a similar bag 10 design but in a different plane 90 degrees to the plan of visual indication of FIGS. 1 and 2. Specifically, the closure 40 and upper edge 30 of the opening are misaligned when the bag 10 is viewed from the top, but movement of the slider 50 in the direction "C" aligns the upper edge 30 to provide indication that successful closure has been achieved. This bag 10 is generally planar, and the misalignment lies perpendicular to the plane of the bag 10. The opposed portions of the upper edge 30 and closure 40 may have sinusoidal or any desired shape so long as the shapes are sufficiently diverse so as to provide the desired visual indication.

The edges 30 of the bags 10 of FIGS. 1–4 may have any irregular shape which provides for misalignment of the bag 10 when it is open. The edges 30 may be sinusoidally-shaped in a preferred embodiment. It is to be recognized that either the edges 30, the closure 40, or both may become substantially colinear and aligned upon closing the bag 10 of FIGS. 1–4.

Figure 5:
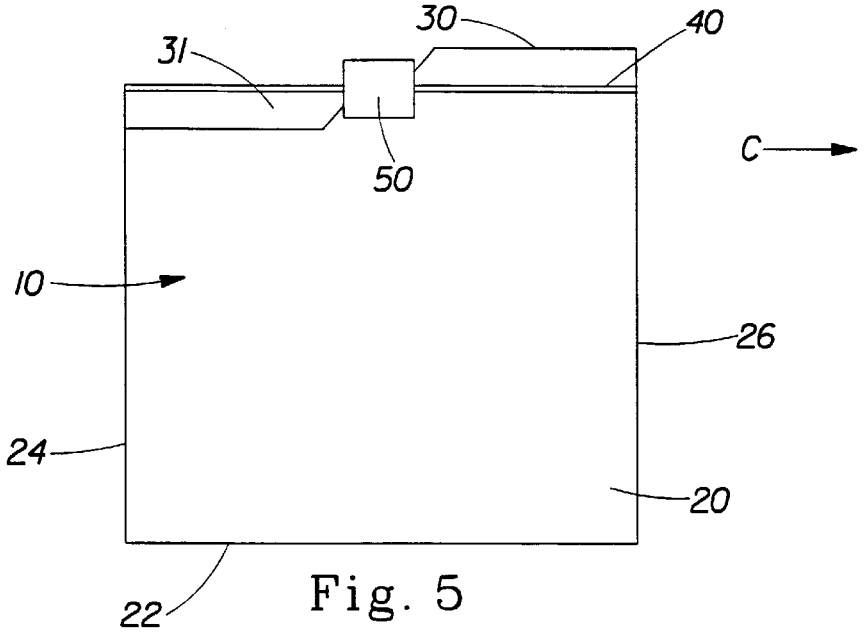
FIG. 5 is an elevational view of another flexible bag employing a closure indicator in accordance with the present invention.

FIG. 5 depicts another embodiment of a flexible bag 10 in accordance with the present invention. The flexible bag 10 includes a slider 50 which, when translated in the direction "C", not only secures the closure 40 but also folds over a flap 31 formed by the upper portion of at least one side of the bag body 20 above the closure 40. The movement of the flap and the corresponding change in the configuration of the upper edge 30 of the bag 10 forming the opening provides a clear visual indication of the status of the closure 40. Suitable indicia may be placed on one or both sides of the flap to state "closed", "open", or the like. One possible modification would be the formation of a pleat instead of rotating an external flap.

Figure 6:
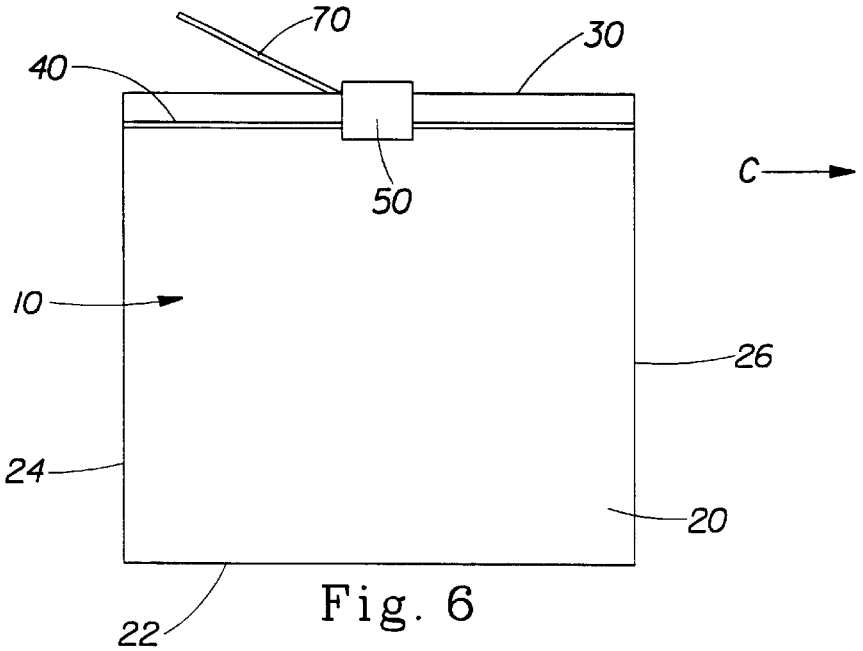
FIG. 6 is an elevational view of a further flexible bag employing a closure indicator in accordance with the present invention.
Figure 7:
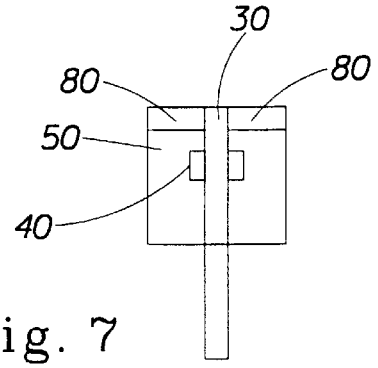
FIG. 7 is an elevational sectional view of the slider of the bag of FIG. 6.

FIG. 6 illustrates a further embodiment of a flexible bag 10 in accordance with the present invention. As shown in FIG. 6, a slider 50 when translated in the direction "C" causes a strip of material 70 to be severed from the upper edge 30 of the bag 10 in a progressive manner as the closure process is completed. When the slider 50 is fully translated, the strip of material 70 falls free or may be readily detached to provide visual indication of successful closure 40 operation via alteration of the bag 10 opening. FIG. 7 illustrates a sectional view of such a slider 50, with one or more sharp knife-like blades 80 extending inwardly where they contact and sever the uppermost portion of the bag 10. Optionally, the blade(s) may be spring-loaded so that they progressively move lower if repeated closure 40 cycles ensue such that a fresh strip of material 70 is severed each time the closure 40 is secured, until insufficient material remains. Severed strips of material may be disposed of in a responsible manner.

If desired, the bag 10 of FIGS. 6–7 may include multiple flaps 31. For example, one flap 31 may be severed or change position as the slider 50 moves in the closing direction. The other flap 31 may change position or be severed as the slider 50 moves in the opening direction. This embodiment is considered to be particularly suitable if the bag 10 is intended for multiple uses, rather than being discarded after a single use.

Various compositions suitable for constructing the flexible storage bags 10 of the present invention include substantially impermeable materials such as polyvinyl chloride (PVC), polyvinylidene chloride (PVDC), polyethylene (PE), polypropylene (PP), aluminum foil, coated (waxed, etc.) and uncoated paper, coated nonwovens etc., and substantially permeable materials such as scrims, meshes, wovens, nonwovens, or perforated or porous films, whether predominantly two-dimensional in nature or formed into three-dimensional structures. Such materials may comprise a single composition or layer or may be a composite structure of multiple materials, including a substrate material utilized as a carrier for a substance.

Once the desired sheet materials are manufactured in any desirable and suitable manner, comprising all or part of the materials to be utilized for the bag body 20, the bag 10 may be constructed in any known and suitable fashion such as those known in the art for making such bags 10 in commercially available form. Heat or adhesive sealing technologies may be utilized to join various components or elements of the bag 10 to themselves or to each other. In addition, the bag bodies 20 may be thermoformed, blown, or otherwise molded rather than reliance upon folding and bonding techniques to construct the bag bodies 20 from a web or sheet of material. Two recent U.S. Patents which are illustrative of the state of the art with regard to flexible storage bags 10 similar in overall structure to those discussed above but of the types currently available are U.S. Pat. No. 5,554,093, issued Sep. 10, 1996 to Porchia et al., and U.S. Pat. No. 5,575,747, issued Nov. 19, 1996 to Dais et al.

Of course, hybrid embodiments of the bag 10 according to the present invention are also suitable and contemplated. For example, the embodiment of FIGS. 1–2 may be combined with the embodiments of FIGS. 3–4 to yield an opening defined by edges 30 which have deviations or undulations in both planes. Furthermore, the embodiment of FIGS. 1–2 and/or FIGS. 3–4 may be combined with the embodiments of FIGS. 5–7 to yield a bag 10 having misaligned edges 31 which further indicate the open, closed, or ongoing closure of the bag 10.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A semi-enclosed flexible bag comprising:

a) a bottom;

b) an upper edge opposite the bottom, further comprising two opposing portions forming an opening;

c) an interlocking mechanical seal disposed on the opposing portions of the upper edge; wherein the opposing portions are misaligned when the flexible bag is open and are substantially collinear when the bag is closed;

the bag is generally planar;

the misalignment of the opposing portions lies in the plane of the bag; and the opposing portions are generally sinusoidally shaped, the sinusoidally shaped portions being out of phase.

* * * * *